United States Patent [19]

Maynard

[11] 4,333,653

[45] Jun. 8, 1982

[54] SAN FRANCISCO CABLE CAR PUZZLE

[76] Inventor: Michael D. Maynard, 4770 W. Mars, Tucson, Ariz. 85704

[21] Appl. No.: 179,975

[22] Filed: Aug. 21, 1980

[51] Int. Cl.[3] ..... A63F 9/12

[52] U.S. Cl. ..... 273/160; 46/17; 46/223

[58] Field of Search ..... 273/160; 46/16, 17, 46/223

[56] References Cited

U.S. PATENT DOCUMENTS

| | | | |
|---|---|---|---|
| 1,129,281 | 2/1915 | Dulgeroff | 273/160 |
| 1,845,201 | 2/1932 | Shepard | 46/17 |
| 2,020,562 | 11/1935 | Miller | 46/28 X |
| 2,432,031 | 12/1947 | Morris | 273/160 |
| 2,651,522 | 9/1953 | Steinhardt | 273/160 |
| 2,712,447 | 7/1955 | Steinhardt | 273/160 |
| 3,546,792 | 12/1970 | Sherman | 273/160 X |
| 3,690,672 | 9/1972 | Dreyer | 46/17 X |
| 3,721,448 | 3/1973 | Coffin | 273/160 |
| 3,939,600 | 2/1976 | Eid | 46/17 |

FOREIGN PATENT DOCUMENTS

| | | | |
|---|---|---|---|
| 1396422 | 3/1965 | France | 46/17 |

OTHER PUBLICATIONS

"Action Puzzle Toys" Advertisement, Playthings, Feb. 10, 1959, p. 135.

*Primary Examiner*—Anton O. Oechsle
*Attorney, Agent, or Firm*—J. Michael McClanahan

[57] ABSTRACT

A take apart wooden toy puzzle which, when assembled resembles a San Francisco cable car. The toy comprises a number of pieces, the majority of which comprise pairs of mirror image constructed pieces which align and are mutually interacting. Two key element pieces must be detected and removed from the puzzle in the correct order in order to disassemble the puzzle. The first set of these elements, the brake posts, must be removed. At this point, the cable car is able to roll upon its wheels without falling apart. Since this initial procedure leaves the toy intact, the next element to be removed is not easily ascertained. The next step consists of disengaging the second step of key elements, the tie posts, which are fitted top to bottom through the puzzle. Once the tie posts are removed, the toy is easily and quickly disassembled. When it is desired to assemble the toy, it is conducted in the reverse order of disassemblage. The pieces of the puzzle are held in place until the tie posts are inserted. The brake posts are then fitted until they engage the tie posts, thereby locking the puzzle in its final position.

10 Claims, 4 Drawing Figures

SAN FRANCISCO CABLE CAR PUZZLE

BACKGROUND OF THE INVENTION

Puzzles of the take apart versions have been known for long times and have provided a source of amusement to young and adult alike.

Many times these puzzles may comprise a single constructed piece, which, by its shape, permits assembly by a plurality of such pieces into many different configurations. Such a puzzle is shown by U.S. Pat. No. 3,721,448, where a symmetrical assembly puzzle comprises twelve elongated pieces where nine of the pieces have one configuration and three pieces a second configuration.

Still other take apart puzzles take on the shape of various objects such as U.S. Pat. Nos. 2,651,522, and 2,712,447, wherein the puzzle detailed in the first patent takes on a dog like appearance and the second puzzle, that of a football. These puzzles were noted for interfitting pieces placed radially away from a central axis which could be quickly separated for easy disassembly. These assemblage puzzles require little or no skill to disengage their component pieces.

SUMMARY OF THE INVENTION

This invention is unique in that it provides a take apart toy of the type where the means to disassemble the toy is not readily apparent and the child or adult which embarks upon taking the toy apart must utilize their ingenuity to observe the toy and then attempt, by looking at the inner connection of the pieces, to ascertain its disassembly procedure.

The present invention contemplates a San Francisco type cable car take apart puzzle comprising a plurality of different and unusually shaped pieces. Many of the pieces being symmetrical. The total puzzle is held in rigid configuration by two key elements, the first and most important of which runs the total depth of the cable car puzzle to hold all pieces together as an assembled unit, and the second of the key elements being a key to engage a keyway in the first key element.

More specifically, the cable car puzzle, in its facsimile of the San Francisco type cable cars, proceeds from an elongated convex upper roof supported upon a windowed transom which in turn rests upon a subroof which continues outward in a generally convex shape to join the main, passenger carrying portion of the body of the cable car.

The main body of the cable car comprises primarily four elongated pieces held together by two H-shaped pieces at opposite ends of the four pieces. The upper two elongated pieces have a plurality of slots cut transversely thereto, which slots are the windows for the cable car puzzle, including the front and rear windows. The lower main body sections, the two elongated base pieces, join the window pieces to terminate the slots which have been formed in the window pieces and thereby provide the bottom portion of the windows in the cable car. Additionally, the base pieces provide centrally located slotways by which to hold the locking assembly to which the wheel assembly is attached.

Locking assemblies, generally "C-shaped" engage at the top portion of their "C" the base pieces and their lower portion the axle housing. Between the inner engagement of the lower portion of the "C-shaped" locking pieces and the axle housing is a slotway through which the wheel assemblies axles are placed.

From the top of the upper convex roof to the wheel assemblies at the bottommost portions of the cable car run the two tie posts, which are in an inverted foot shape, and where the upper portion of the foot engages a stepped slotway through the upper roof. The columnar portion of the tie posts runs to the bottom through provided slotways in all the major components of the cable car to where, at the very bottom, a square shaped elongated key, running transversely to the cable car length through the axle housing, engages the positioned keyway in the tie post. The key functions, in addition to holding the tie post, as the brake which engages two pairs of the eight wheels.

The toy, once assembled, then provides a puzzle to the user to determine, by looking and studying the toy, how the toy is disassembled. Disassembly is in the reverse order of assembly, commencing first with the brake, which, when removed, permits upward removal of the tie post. Upon removal of the tie post the upper roof and subroof come apart leaving the main body of the cable car in still assembled configuration. The two elongated window pieces then are lifted upward away from the end holding "H" pieces. Removing the elongated window pieces then exposes for removal the "H" shaped connection pieces which, when moved upward and away, permit the two elongated base pieces to move sideways away from the "C" shaped locking assemblies. Upon removal of the base pieces, the locking assemblies, axle housing, and wheel assemblies remain. Moving upward the axle housings through the uppermost portion of the "C" shaped locking assemblies permits the wheel assemblies to be removed whereupon, the axle housings may then be pulled away from the locking assemblies presenting, at this point, a completely disassembled puzzle.

It is therefore, an object of this invention to provide a new and an improved take apart toy which will provide a challenge to the user to disassemble by logically determining the key pieces.

It is yet another object of the present invention to provide a mobile take apart toy with the characteristics of an assembly puzzle and to thus incorporate the features of an asthetically pleasant take apart toy with those of an intellectually stimulating assembly puzzle.

The foregoing and other objects, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
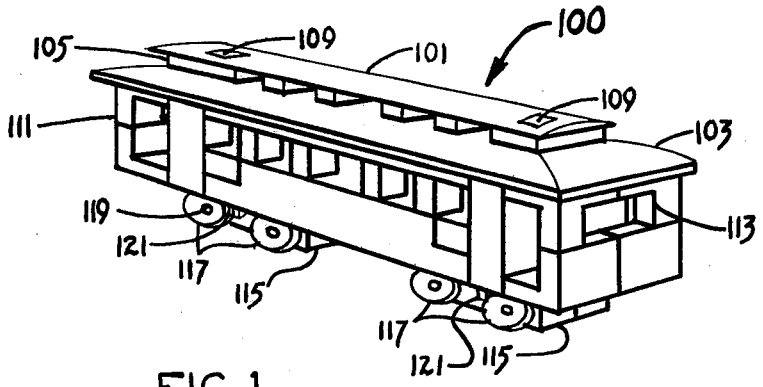
FIG. 1 is a perspective view of the subject invention in a fully assembled configuration.

Referring now to FIG. 1, the take apart toy cable car puzzle is shown in its completed assembled state with its two key elements visible which permit the take down and disassembly of the toy.

More specifically and with reference to FIG. 1, the upper roof 101 is shown rising above subroof 103. Upper roof 101 is an elongated rectangular, slightly convex shaped roof which covers centrally located similarly shaped subroof 103. Upper roof 101 is elevated above subroof 103 by the transom 105. Located in transom 105 are a plurality of transom windows 107, nominally five which, in the subject invention, are spaced below the length of upper roof 101.

Shown penetrating the upper surface of roof 101 are the tops of one of the two key elements in disassembly of the invention, the two tie posts 109. These tie posts, as will be more fully illustrated in FIG. 2, run the entire depth of the cable car puzzle and connect to the wheel undercarriage structure.

Figure 2:
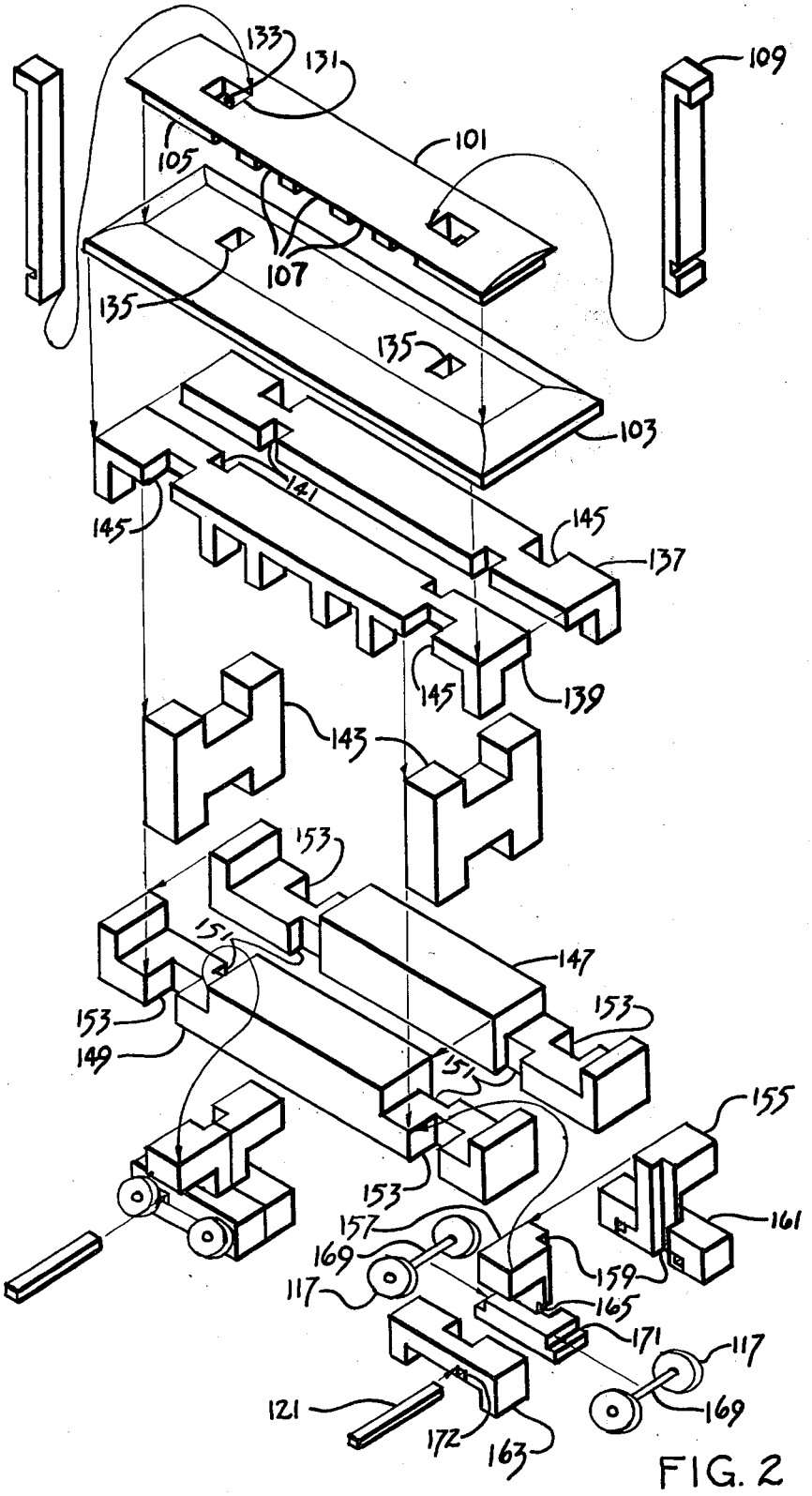
FIG. 2 is an exploded view of the subject invention shown in assembly order.

Continuing, dropping below subroof 103, are two vertical sides 11 which have a plurality of side windows and doors. These vertical sides are composed substantially of two pieces, namely the upper window piece and the lower base piece (detailed in FIG. 2). The windows and upper portion of the doors in vertical side 111 are cut from the upper window piece 139 (FIG. 2). To the front of the cable car 100 is the front observation window 113 which, similarly to the side windows, is formed from the upper window pieces 139 and 137, (FIG. 2).

Directly below the vertical sides 111 are the two wheel undercarriage pieces 115, which hold the wheel sets 117 by means of holding their central wheel axle 169. Engaging two of the wheel sets 117 is the second of the two key elements that hold the cable car puzzle together namely the brake 121. Brake 121, an elongated post, engages a keyway in tie post 109 (FIG. 2). Brake 121, of which there are two, also physically engage two of the wheel sets 117 and, when so engaged, prevent the wheels from turning, or if forced, turn with resistance to turning.

Since all parts of the inventive cable car puzzle are functional, the puzzle is to determine which parts must be removed, and in more particularity, the order of removal, to disassemble the puzzle. Here, the two brakes, 121, must be slid out of their position engaging the wheel sets 117 which, when accomplished, unlocks the two tie posts 109 which then, once removed, permit easy continued disassembly of the puzzle.

It is noted that even with the brakes 121 removed, the puzzle will not come apart. Thus, removal of the brakes will permit the cable car to roll upon its wheels but, by their absence, do not indicate that the next pieces to be removed are the tie posts. In fact, due to the friction between the tie posts and surrounding pieces, the puzzle will stay together. Even if the cable car is turned over, the friction holding the tie posts is sufficient to prevent the tie posts from falling out by gravity. Thus, the cable car may be rolled upon its wheels without danger of automatic disassembly or falling apart.

Referring now to FIG. 2, an exploded view of the disassembled cable car puzzle is illustrated. Starting with the topmost part of the disassembled cable car, upper roof 101, which is a solid piece of wood or plastic, has a convex shaped roof covering transom 105. Cut at opposite ends through the upper roof 101 are rectangular slots 131 which, as can be seen in FIG. 2, have step 133 formed in the slot partially blocking the lower opening of the rectangle formed by slot 131. Feeding through both ends of roof 101 are the tie posts 109 which, in their upper extremity, are foot shaped such that the foot sets into the upper part of slot 131 which is not partially blocked by step 133, with the column portion of tie post 109 penetrating through slot 131.

Directly below upper roof 101 is subroof 103 adapted to receive the transom 105 of upper roof 101. Subroof 103 comprises essentially two parallel planar surfaces, the upper surface of which receives transom 105 and continues with a rounded chamber on all sides, such as to make a discontinued convex roof. Subroof 103 is substantially a solid piece of wood or plastic and has two openings 135 therethrough in alignment with the completed openings formed by slot 131 through upper roof 101, adapted to receive the column portion of tie posts 109.

Immediately below subroof 103 are the two window pieces 137 and 139. As can be seen, these two pieces are mirror images of each other. Basically these pieces comprise an upper and lower parallel planar surface with the bottom portion having a plurality of protrusions extending therefrom, the protrusions generally forming the vertical sides 111 (FIG. 1) with the openings forming the plurality of windows along the sides as well as the front and back observation windows 113 (FIG. 1). Notches 141 cut interiorly to the sides of window pieces 137 and 139 are adapted to accomodate the column portion of tie posts 109.

The window pieces 137 and 139 are held together by means of connection pieces 143 which are in the shape of the letter "H". These pieces engage the four outside notches 145 of window pieces 137 and 139.

Proceeding below the connection pieces 143, are base pieces 147 and 149 which, like the window pieces 137 and 139, are mirror images of each other. Base pieces 147 and 149 comprise the lower half of the vertical sides 111 shown in assembled configuration in FIG. 1. As with window pieces 137 and 139, a plurality of inside notches 151 are adapted to accommodate the column portion of tie posts 109. Outside notches 153 of the bases pieces 147 and 149 accommodate the lower leg portions of "H" shaped connection pieces 143, thereby holding base pieces 147 and 149 against each other.

Directly below base pieces 147 and 149 are the wheel undercarriage assemblies. This undercarriage assembly comprises the "C" shaped locking assembly 155 and 157, which are mirror images of each other, comprising generally an upright column attached to a pedestal with a foot formed at the top of the upright column.

In assembly, the upright column of locking assemblies 155 and 157 fits into notches 151 cut in base pieces 147 and 149. Step 159 cut into the columns of 155 and 157 is adapted to longitudinally receive the tie posts 109. Obviously then, the interior notches 151 are oversized, being adapted to receive the column of locking assemblies 155 and 157 plus the tie posts 109.

Locking assembly 155 is shown assembled at the lower left hand portion of FIG. 2 together with axle housing 161. Locking assembly 157 is shown disassembled and apart from axle housing 163 at the lower most portion of FIG. 2. Shown at the bottom of the columnar portion of locking assembly 157 is notch 165 which is adapted to receive brake 121. Axle 169, which is attached to wheels 117, fits into steps 171 cut at opposite ends of the lower pedestal portion of locking assembly 155 and 157.

In assembly, the central columnar portion of locking assembly 155 and 157 are fitted into the central notches cut in axle housing 161 and 163 respectively. Locking assemblies 155 and 157 are then held together, back to back, and axles 169, to which the two pairs of wheels 117 are attached, are then inserted into the steps 171 which are formed in the lower pedestal portion of locking assemblies 155 and 157. At that point, the axle housings 161 and 163 are then slid down upon the central post portions of locking assemblies 155 and 157 until the ends of axle housing 163 and 161 encompass the axles 169, holding the axles in place.

The front wheel undercarriage is shown disassembled on the right while the rear undercarriage is shown assembled on the left in FIG. 2 for ease of assembly.

Brake 121 is then inserted through the notch 172 which has been cut in axle housing 163, through notch 165 cut in the column portion of locking assembly 155 and 157, and then to the opposite side of axle housing 161. As had been mentioned before, both locking assemblies 155 and 157 are constructed as mirror images of each other as well as are axle housings 161 and 163.

Once the wheel undercarriage assembly has been assembled, base pieces 147 and 149 are brought together with notches 151 therein engaging the columnar portion of the locking assemblies 155 and 157. At this point, connection pieces 143 then may be inserted into the outside notches 153 of base pieces 147 and 149. Then window pieces 137 and 139 fit upon connection pieces 143 by outside notches 145 therein engaging the upright arms of the connection pieces 143. Subroof 103 is placed over the window pieces 137 and 139, roof 101 placed on top of subroof 103, and then tie posts 109 inserted through the slot 131 of the roofs down through the corresponding opening 135 in subroof 103, notches 141 in window pieces 137 and 139, and the step 159 formed in locking assemblies 155 and 157. At this point in time, brakes 121, which have already been inserted into axle housing 161 and 163 must be removed in order to insert tie posts 109 to their furthermost down position. When this has been accomplished, brakes 121 are re-inserted at which time the brake engages the notch cut in the lower section of the tie posts 109. At this point the cable car puzzle has been completely assembled.

Disassembly of the cable car puzzle is accomplished in the reverse order of assembly, namely by first removing brakes 121, then urging tie posts 109 up from the bottom and out roof 101. This then frees roof 101, and subroof 103. At this point, window pieces 137 and 139 may be lifted up off of the upright arms of connection pieces 143. Window pieces 137 and 139 are then followed by connection pieces 143 which leaves base pieces 147 free to move horizontally, disengaging from the upper foot portion of locking assemblies 155 and 157. Once the base pieces 147 and 149 have been freed, locking assemblies 155 and 157 are pushed down so that the foot on the top of the column engages the top of axle housing 161, freeing axles 169 of wheels 117. Once the axles are freed, then axle housing 161 may be pulled horizontally away from locking tabs 155 and 157 and the puzzle has been completely disassembled.

Figure 3:
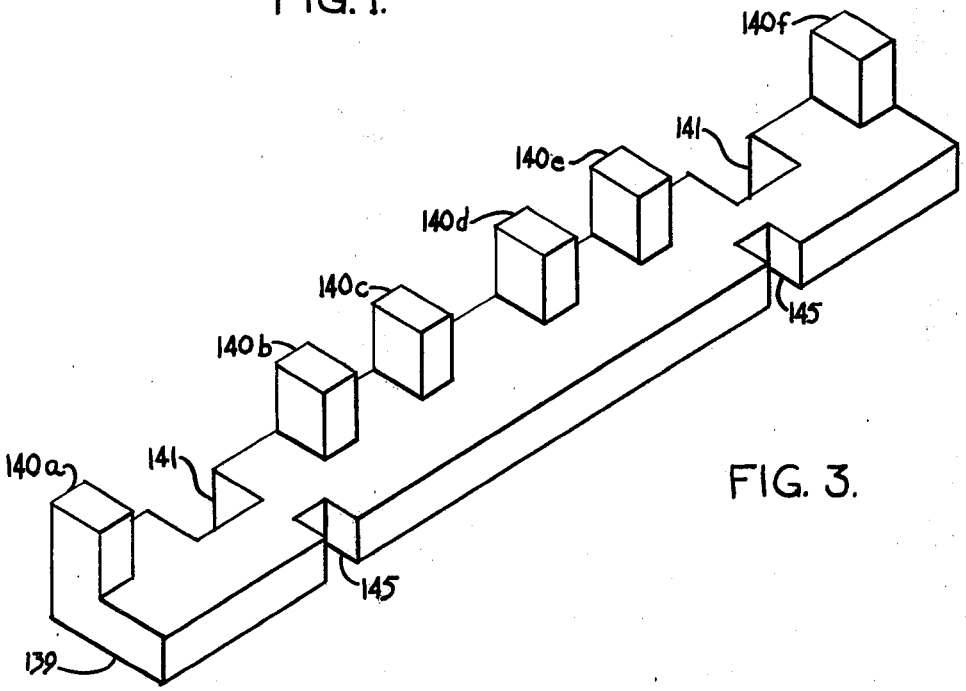
FIG. 3 is a perspective view of the bottom side of one of the elongated window pieces.
Figure 4:
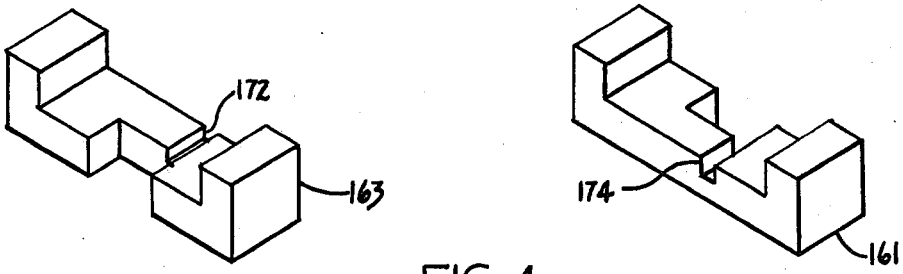
FIG. 4 is a perspective view of the two mirror image axle housings.

Referring now to FIGS. 3 and 4, constructional views of the various pieces comprising the cable car puzzles whose construction is not readily apparent from FIG. 2 are now fully illustrated.

Referring first to FIG. 3, a bottom perspective view of window piece 139 is detailed showing the upright protrusions which form the side windows in the cable car puzzle, the protrusions however being downward from the lower planar surface of window piece 139 as shown in FIG. 2. As illustrated in FIG. 3, window piece 139 has been revolved along its longitudinal axis by one-half turn and then rotated counterclockwise by one quarter turn from its illustration of FIG. 2. Shown in FIG. 3 in window piece 139 are notches 145 adapted to receive the upper arms of connection piece 143, and notches 141 which are adapted to receive tie posts 109. The upward rising protrusions which are variously labeled 140*a* through 140*f* form, together with connection pieces 143, the side and end windows of the cable car.

The only other pieces to the inventive puzzle which construction are not apparent from FIG. 2 are the mirror imaged axle housing 161 and 163.

Referring now to FIG. 4, axle housing 163 as shown in the lower most portion of FIG. 2, is illustrated. Here, the piece has been rotated along its longitudinal axis by one-half turn. Adjacent to axle housing piece 163 is axle housing piece 161 which, like axle housing piece 163 has been rotated along its longitudinal axis from its illustration shown in FIG. 2 by one-half turn. It is important to note that the pieces 163 and 161 are mirror images of each other and that the notch 172 cut in piece 163 does continue into notch 174 when these pieces are joined together in their assembled position.

As many changes could be made in the above puzzle construction and method of making the same, and many widely different embodiments of this invention could be made without departing from the scope of the claims, it is intended that all matter contained in the above description shall be interpreted as illustrative and not in a limiting sense.

Having now particularly described and ascertained the nature of the invention, and in what manner the same is to be performed, it is recognized that the scope of the invention is defined and limited only by the claims which follow.

I claim:

1. A puzzle assemblage take-apart toy resembling the San Francisco cable car comprising a plurality of interlocking parts each forming part of the structure, each of said parts having a fitting connection in respect to each of said other parts and each of said parts being mounted in sequence upon preceding assembled parts, said parts being assembled in a predetermined sequence to form the San Francisco cable car, all said parts held in fixed configuration by two key pieces, said parts defining an upper roof piece, a subroof connected to and spaced below the upper roof piece, window pieces connected to and spaced below said subroof, base pieces connected to and spaced below said window pieces, axle housings connected to and spaced below said base pieces, and wheels connected to said axle housings whereby when all said pieces are assembled, said toy resembles a San Francisco cable car whereby said puzzle assemblage take-apart toy may be assembled by placing in order each part and, when assembled, inserting said key pieces to hold said toy in final fixed configuration.

2. The puzzle assemblage take-apart toy as defined in claim 1 wherein said key pieces holding said toy in fixed configuration comprise tie posts, said tie posts adapted to engage said upper roof piece, said subroof, said window pieces, said base pieces, and said axle housing in fixed alignment.

3. The puzzle assemblage take-apart toy as defined in claim 2 further including brake pieces, said brake pieces engaging and securing said tie posts.

4. The puzzle assemblage of claim 3 wherein said upper roof piece comprises an elongated rectangular convex shaped roof surface and transom, said transom situated immediately below the upper roof surface and having at least five windows therein, said upper roof surface having a pair of openings cut therein adapted to receive said tie posts, said openings additionally having a step therein partially blocking the lower section of said opening.

5. The puzzle assemblage as defined in claim 4 wherein said subroof comprises two parallel planar surfaces, the upper surface of which receives said transom and has a discontinued convex roof continuing from said upper planar surface to substantially the lower planar surface, said subroof also penetrated by two openings adapted to receive said tie posts.

6. The puzzle assemblage as defined in claim 5 further including "H" shaped connection pieces engaging said window pieces and said base pieces in fixed alignment; and locking assemblies, said locking assemblies engaging said base pieces and said axle housings in fixed arrangement.

7. The puzzle assemblage as defined in claim 6 wherein said window pieces defines a pair of elongated, rectangular planar surfaced parts, said parts being mirror images of each other, each of said parts having projections and recesses, said projections forming windows for said cable car, and the recesses adapted to receive said tie posts and said "H" shaped pieces respectively.

8. The puzzle assemblage as defined in claim 7 wherein said base pieces comprise an elongated pair of rectangular cross-sectioned, mirror imaged parts, each of said base parts having oppositely directed projections and recesses, said projections adapted to form doorways with said window pieces in said cable car, and said recesses adapted to receive said tie posts, said "H" shaped connection pieces and said locking assembly.

9. The puzzle assemblage as defined in claim 8 wherein said wheels comprise at least four pairs of wheels, each of said pair connected by an axle, two of said axles encompassed and held in place by each of said axle housings.

10. The puzzle assemblage as defined in claim 9 wherein said brake pieces define at least two elongated square posts, said brake pieces adapted to engage and hold in place said tie posts, and to engage certain of said wheels exterior annular surfaces.

* * * * *